US006077396A

United States Patent [19]

LaRiviere

[11] Patent Number: 6,077,396

[45] **Date of Patent: *Jun. 20, 2000**

[54] APPARATUS FOR FLUFFING AND CONTACTING HIGH CONSISTANCY WOOD PULP WITH A GASEOUS BLEACHING REAGENT

[76] Inventor: Christopher J. LaRiviere, 144 Colburn Rd., Milford, N.H. 03055

[ * ] Notice: This patent is subject to a terminal disclaimer.

[21] Appl. No.: 08/857,610

[22] Filed: May 16, 1997

[51] Int. Cl.[7] ..... D21C 1/10; D21C 9/153; D21D 5/20

[52] U.S. Cl. ..... 162/243; 162/57; 162/261; 366/303; 366/304; 366/305; 366/307

[58] Field of Search ..... 162/23, 246, 57, 162/261, 243, 65; 366/303, 304, 305, 307; 8/156; 241/22

[56] References Cited

U.S. PATENT DOCUMENTS

| | | | |
|---|---|---|---|
| 1,827,710 | 10/1931 | Leyst-Kuchenmeister . | |
| 2,627,668 | 2/1953 | Handwerk | 34/33 |
| 2,722,163 | 11/1955 | Cumpston, Jr. | 92/26 |
| 2,723,194 | 11/1955 | Birdseye | 92/1 |
| 2,963,086 | 12/1960 | Green | 162/237 |
| 3,293,117 | 12/1966 | Pennington, Jr. et al. | 162/236 |
| 3,471,093 | 10/1969 | Wienert | 241/30 |
| 3,579,717 | 5/1971 | Middlebrooks | 18/1 |
| 3,630,828 | 12/1971 | Liebergett et al. | 162/24 |
| 3,725,193 | 4/1973 | DeMontigny et al. | 162/57 |
| 3,785,577 | 1/1974 | Carlsmith et al. | 241/34 |
| 3,814,664 | 6/1974 | Carlsmith | 162/236 |
| 3,917,176 | 11/1975 | Carlsmith | 251/55 |
| 3,964,962 | 6/1976 | Carlsmith | 162/41 |
| 4,080,249 | 3/1978 | Kempf et al. | 162/57 |
| 4,096,027 | 6/1978 | Sherman | 162/18 |
| 4,123,317 | 10/1978 | Fritzvold et al. | 162/17 |
| 4,278,496 | 7/1981 | Fritzvold | 162/19 |
| 4,279,694 | 7/1981 | Fritzvold et al. | 162/28 |
| 4,283,251 | 8/1981 | Singh | 162/17 |
| 4,298,426 | 11/1981 | Torregrossa et al. | 162/57 |
| 4,303,470 | 12/1981 | Meredith et al. | 162/65 |
| 4,426,256 | 1/1984 | Johnsen | 162/237 |
| 4,468,286 | 8/1984 | Johnsen | 162/17 |
| 4,581,104 | 4/1986 | Luthi | 162/43 |
| 4,664,320 | 5/1987 | Steffens | 241/160 |
| 4,729,516 | 3/1988 | Williams, Jr. | 241/186 |
| 4,744,722 | 5/1988 | Sampi et al. | 415/121 |
| 4,908,101 | 3/1990 | Frisk et al. | 162/261 |
| 5,087,326 | 2/1992 | Jones | 162/244 |
| 5,174,861 | 12/1992 | White et al. | 162/57 |
| 5,181,989 | 1/1993 | White et al. | 162/241 |
| 5,188,708 | 2/1993 | Griggs et al. | 162/40 |
| 5,198,075 | 3/1993 | de La Bruniere et al. | 162/19 |
| 5,277,371 | 1/1994 | Bowns et al. | 241/154 |
| 5,364,038 | 11/1994 | Prew | 241/189 |
| 5,409,570 | 4/1995 | Griggs | 162/40 |
| 5,451,296 | 9/1995 | Pikulin et al. | 162/241 |
| 5,562,806 | 10/1996 | Abdulmassih et al. | 162/261 |
| 5,626,297 | 5/1997 | Carlsmith et al. | 241/57 |
| 5,630,909 | 5/1997 | LaRiviere | 162/243 |

FOREIGN PATENT DOCUMENTS

| | | |
|---|---|---|
| 646267 | 7/1971 | Australia . |
| 896267 | 5/1968 | Canada . |
| 2046717 | 7/1991 | Canada . |
| 0 492 040 A1 | 6/1991 | European Pat. Off. . |
| 0 515 303 A1 | 5/1992 | European Pat. Off. . |
| 2620744 | 9/1987 | France . |
| WO 91/18145 | 11/1991 | WIPO . |
| WO 92/07999 | 5/1992 | WIPO . |
| WO 94/15018 | 7/1994 | WIPO . |
| WO 95/08667 | 3/1995 | WIPO . |

*Primary Examiner*—Steven Alvo

[57] ABSTRACT

A guide vane is provided in a pin fluffer to assist in pulp mat retention during fluffing by providing a cyclic lift component to the mat as it passes over the vane thereby also further increasing retention time obtained in the fluffer.

14 Claims, 4 Drawing Sheets

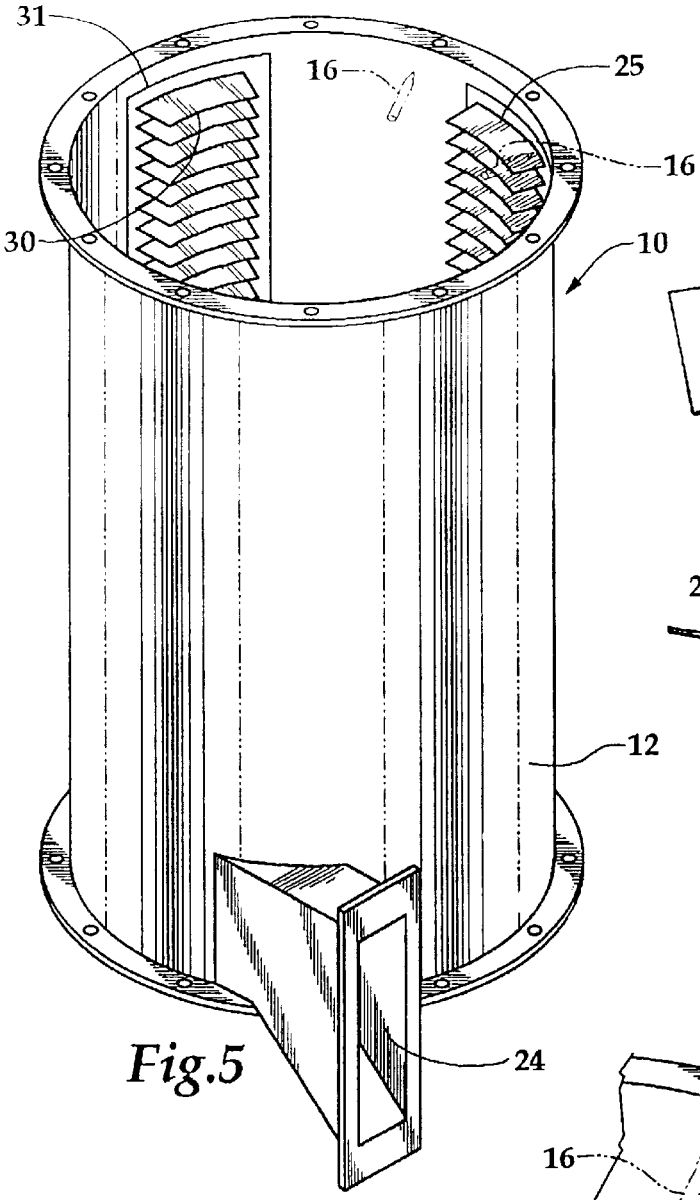
Fig.5
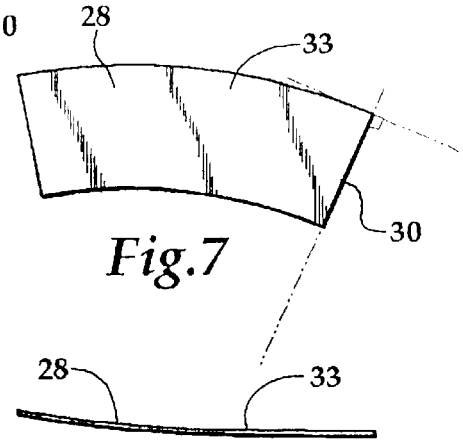
Fig.7
Fig.8
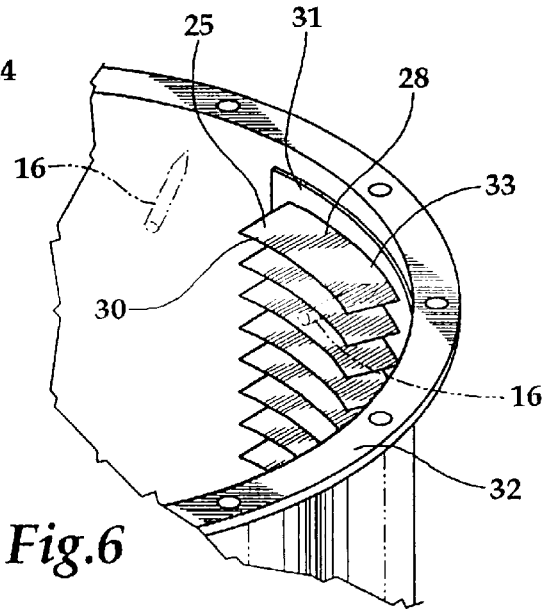
Fig.6

APPARATUS FOR FLUFFING AND CONTACTING HIGH CONSISTANCY WOOD PULP WITH A GASEOUS BLEACHING REAGENT

BACKGROUND OF THE INVENTION

This invention relates generally to pulp manufacturing processes and equipment, and more particularly to an apparatus for fluffing high consistency pulp in the presence of a gaseous bleaching agent for promoting intimate contact between pulp and bleaching reagent. A related invention is described in U.S. patent application Ser. No. 08/335,282, now U.S. Pat. No. 5,630,909, to the same inventor.

Also, more particularly, the present invention relates to a means of manipulating wood pulp fibers within a rotary pin type fluffer to extend the fluffing time in the presence of a gaseous bleaching agent.

As is known, wood pulp is obtained from the digestion of wood chips, from repulping recycled paper, or from other sources and is commonly processed in pulp and paper mills in slurry form in water. Recently there have been many efforts to use ozone as a bleaching agent for high consistency wood pulp. Although ozone may initially appear to be an ideal material for bleaching lignocellulosic materials, the exceptional oxidative properties of ozone and its relatively high cost in the past have limited the development of satisfactory devices.

The primary characteristic of pulp slurries which changes with the consistency of the slurry is the fluidity. Wood pulp in the high consistency ranges (above 18–20% oven-dry consistency) does not have a slurry like character, but is better described as a damp, fibrous sold mass. High consistency pulp can be fluffed, in the same way that dry fibrous solids such as cotton or feathers can be fluffed, to give the pulp a light and porous mass, the inner fibers of which are accessible to a chemical reagent in gaseous form.

The characteristic of compressibility of fluffed pulp, however, makes it difficult to move or transport in conventional solids bulk handling equipment without increasing the bulk density and reducing the porosity (void volume).

To realize fully the advantages of the gas phase reaction in a multistage bleaching of cellulosic fibrous pulp, the comminution of the pulp to produce the fluffed pulp must be of a specific nature so as to produce fragments which independent of their size are of low density, and of porous structure throughout and substantially free from any highly compressed portions, i.e., compacted fibre bundles. Only when this form of comminuted pulp is achieved can the gaseous reactants reach all parts of the comminuted pulp fragments, and thus ensure that the reaction of the gaseous reagent with the fluffed pulp proceeds rapidly and uniformly. The concern for uniformity of contact between the fluffed pulp and the bleaching reagent gas, in the case of ozone bleaching, is fostered by the rapid reduction in the concentration of ozone gas in contact with the fluffed pulp. This reduction is attributable to the extremely fast reaction rate of ozone with wood pulp. Since the reaction rate is concentration dependent, this characteristic increases the non-uniform bleaching results attendant upon the variable permeability of the pulp.

As described hereinabove, the fluffed pulp mass is easily compressed by the action of bulk solids handling equipment to form wads and clumps having much higher density and much lower gas permeability. Bleaching gas flows much more slowly through such wads and clumps and much more rapidly through the wad-to-wad contact areas. The result is overbleached contact areas and underbleached wad cores. Thus, it has been found that bleaching systems which employ conventional bulk materials handling equipment to move high consistency fluffed pulp through a bleaching retention chamber while bleaching it with ozone gas cannot successfully produce uniformly bleached pulp fiber.

Pin shredders and fluffers are used in pulp and paper manufacture and in many other industries for shredding sheet material or fluffing fibrous materials. The size of the particle produced by such a pin shredder depends on several factors such as the size and spacing of the pins, the speed of rotation, retention time, and housing clearance.

An example of such a machine is a fluffer used in high consistency bleaching experiments, and which is described in U.S. Pat. No. 3,725,193 to De Montigny. However, while this machine, and other similar machines, may have operated with varying degrees of success, these machines suffer from a plurality of shortcomings which have detracted from their usefulness.

For example, a disadvantage of using a screen (as suggested in De Montigny) to retain the coarse particles within the housing arises from the fibrous and floccular nature of moist wood pulp. For the flocs to pass through screens, the apertures or slots must be undesirably large, which will result in permitting unfluffed particles of similar size to pass.

Another class of known pin rotor machines used in pulp and paper manufacture consists of a cylindrical housing containing stationary pins on the inside which interleave with pins disposed on a rotor. Such high speed pin rotor machines have operated with varying degrees of success in the low to medium consistency ranges for processing wood pulp, for example as a steam mixer. However, these machines do not operate satisfactorily when processing high consistency pulp, because at high consistency the pulp fibers cling to the base of the stationary pins as they are thrown against them by the rotating pins and by the centrifugal forces of the rotating pulp mass, and the fibers build up to form a plugging condition in the housing, impeding thru flow of the wood pulp being processed.

The foregoing illustrates limitations known to exist in present machines for fluffing and manipulating high consistency wood pulp. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, a suitable alternative is accomplished by providing a fluffing contactor comprising a cylindrical shell having a solids inlet adjacent one end and a solids outlet adjacent an opposite end and a gaseous reagent inlet for introducing the reagent into the shell; a cylindrical rotor mounted for rotation within the shell of sufficient diameter to form a restricted annular space of convenient axial length; the rotor being further provided with a plurality of pin-like radially extending projections for imparting a circumferential swirl to solid, fibrous material introduced within the shell; the shell being further provided with a plurality of guide foils projecting into the annular space intermediate the rotary paths subscribed by the pin-like projections and oriented generally parallel to the rotary paths for a first combing portion and at an arcuate angle to the rotary paths for a second axially directing portion, the guide foils designed so as to be less expensive to manufacture than designs previously utilized.

Also, in accordance with the present invention, a device is provided for optimizing the reaction between a gaseous bleaching reagent and a volume of high consistency wood pulp by fluffing the pulp in the presence of the reagent gas for a sufficient period of time to assure the production of good fluff which has been intimately contacted with the reagent gas by the repeated mechanical action of the fluffer in an extended action path.

The foregoing and other aspects will become apparent from the following detailed description of the invention when considered in conjunction with the accompanying drawing figures.

BRIEF DESCRIPTION OF THE DRAWING FIGURES

FIG. 5 is a perspective view illustrating one possible embodiment of the apparatus of FIGS. 2 and 3, illustrating the longitudinally disposed guide vanes formed on the housing interior;

FIG. 6 is an enlarged perspective view of an embodiment of the apparatus of the present invention taken in the area indicated on FIG. 5;

FIG. 7 is a plan view of a guide foil according to the present invention; and FIG. 8 is a side elevation view of a guide foil according to the present invention.

DETAILED DESCRIPTION

A rotary pin type fluffer contactor has been described in patent application Ser. No. 08/125,053 assigned to the same Assignee as the present invention. A vertical axis version (shown in FIG. 1) uses a conical surface to control the motion of the fibers passing through the machine.

Figure 1:
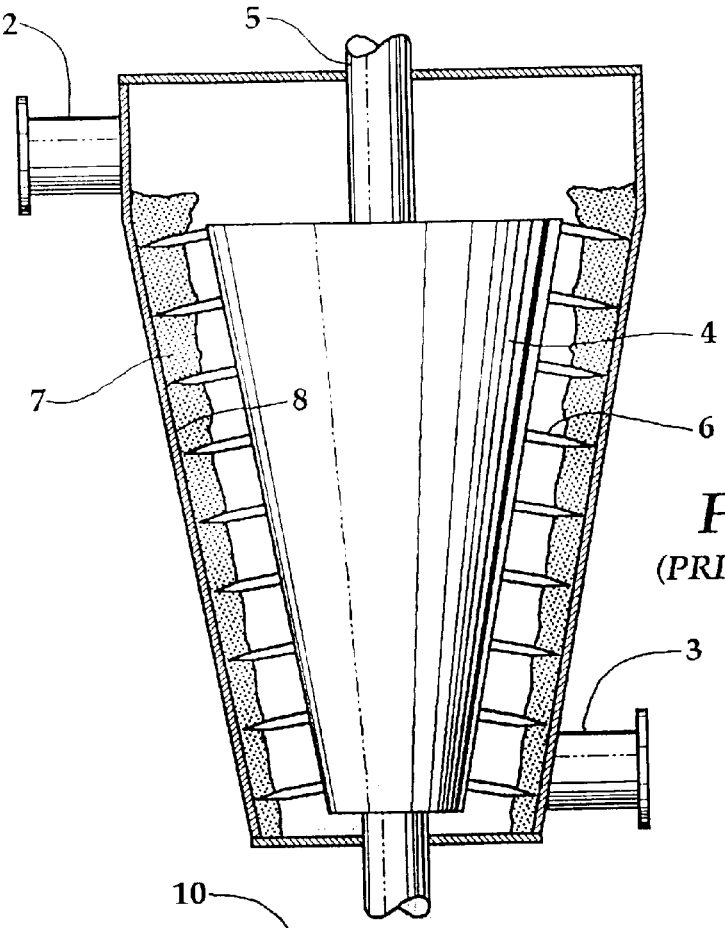
Fig.1 (PRIOR ART)
FIG. 1 is a cross-sectional view of an apparatus according to the prior art and wherein an apparatus housing is illustrated in cross-section to expose a pin rotor rotatably mounted therein.

As shown in FIG. 1, a conventional fluffer is comprised of a generally conical housing 1 having an inlet 2 and an outlet 3 for receiving and discharging pulp fiber respectively. A pin rotor 4 is shown which is also generally conical in section and is mounted for rotation within the housing 1 on a shaft 5 which extends through the housing. The rotor is further provided with a plurality of pin-like projections 6 which extend from the rotor to a point proximate the internal wall of the housing.

Pulp fibers enter the machine through inlet 1, where they are then caused to be spun about the circumference of the machine by the combing action of the rotor 4 and pins 6. In a vertical machine, the centrifugal force of the pulp fiber mat 7 acting against the conical surface 8 causes the downward motion of the pulp fiber mat due to gravity to be retarded. This conical surface also can be used to provide a means of traversing the pulp fibers through a horizontal machine.

For a given rate of rotation of the pulp fiber mat and a given radius of rotation, there is a conical angle of the housing that will cause an upward force on the pulp mat just equal to the downward force of gravity. To achieve a controlled downward flow of pulp the rotational speed of the rotor is adjusted to a slightly slower speed than the "equilibrium" speed. This is a delicate balance, and in practice the downward velocity increases toward the bottom of the housing as the radius gets smaller, so that the mat thickness becomes thinner as shown in FIG. 1.

There is a maximum thickness of pulp mat which can be properly agitated and fluffed by a pin rotor. An uneven pulp mat causes the fluffer to be inefficiently loaded, resulting in the need for a larger and less economical machine. The conical shape of the machine is not space efficient.

Figure 3:
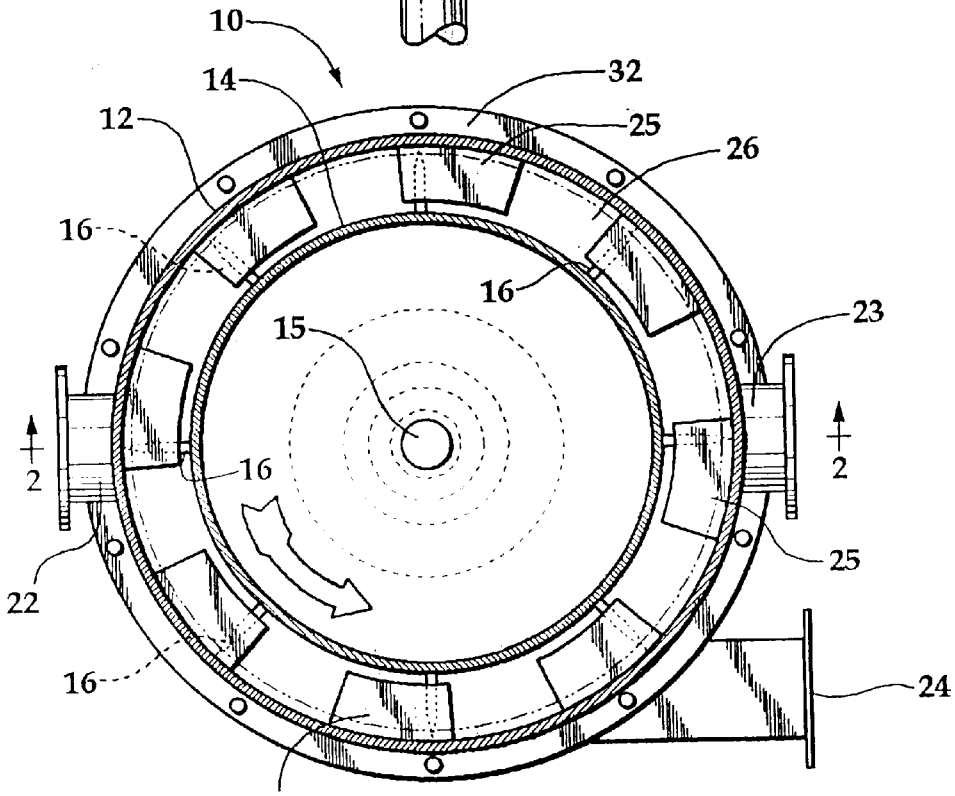
FIG. 3 is a cross-sectional view of the embodiment of the apparatus of the present invention shown in FIG. 2, taken along line 3—3 of FIG. 2.
Figure 2:
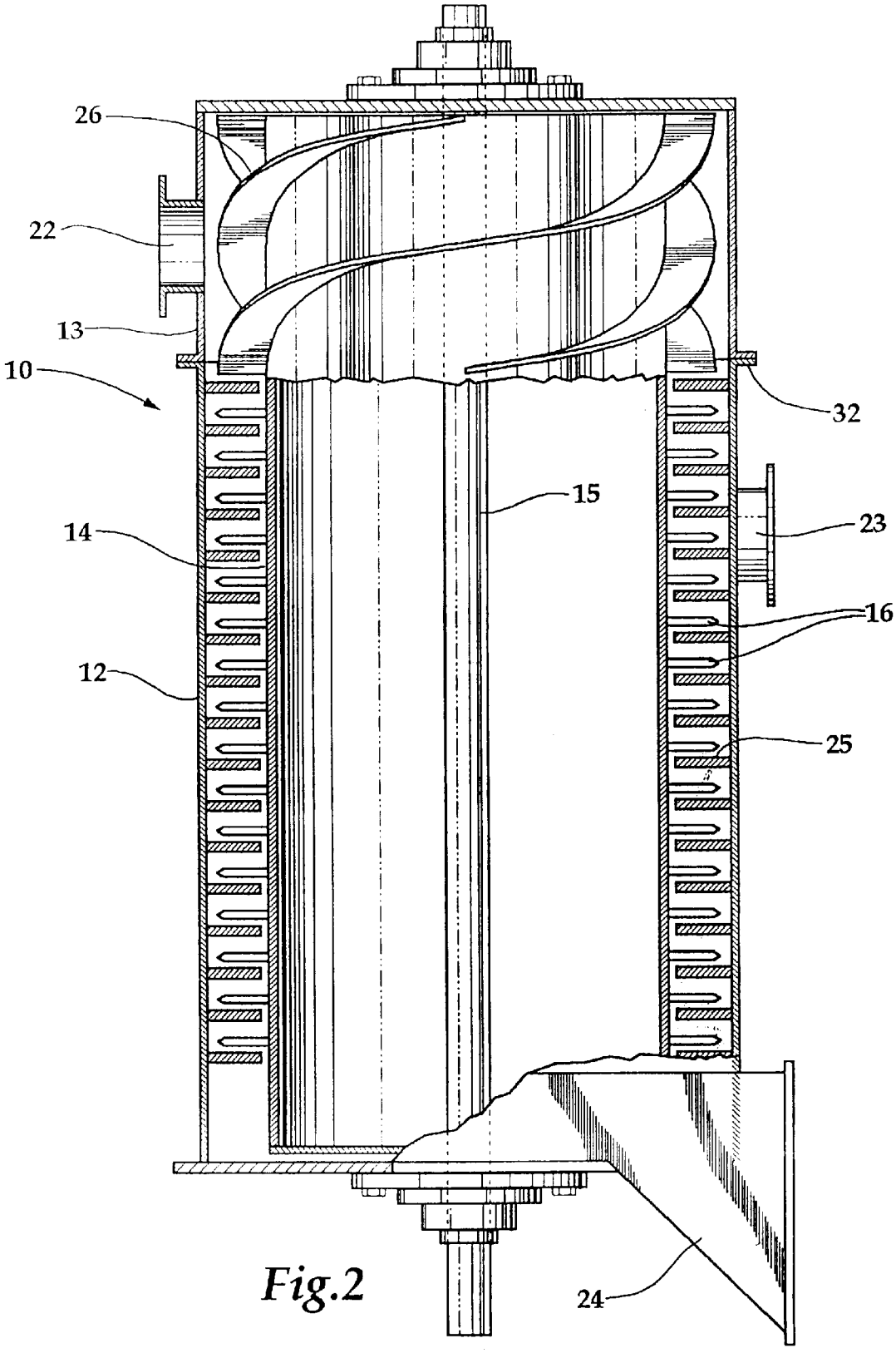
FIG. 2 is a cross-sectional view of an embodiment of the apparatus of the present invention.

FIGS. 2 and 3 illustrate a contemplated commercial embodiment of an apparatus 10 embodying the present invention, which is designed for continuously fluffing a high volume of high consistency wood pulp, and for continuously promoting intimate contact between the high consistency pulp and a gaseous bleaching reagent. A housing is formed in two parts, each having a radially outwardly extending flange to form a flange connection 32 between the lower housing 12 and upper housing 13. The upper housing 13 receives a continuous stream of high consistency wood pulp from a feeding and gas seal forming device (not shown) which compacts the high consistency wood pulp into a gas tight plug. The plug is introduced in the fiber inlet 22. A pin rotor shaft 15 rotatably supports and drives a pin rotor drum 14. The upper portion of the pin-rotor drum 14 is provided with helical shredder vanes 26 having teeth-like surfaces (not shown) around the outer periphery thereof, which break up the plug into small pieces and convey the pieces into the lower housing 12 for fluffing and contacting with a gaseous bleaching reagent.

The helical formed shredding vanes 26 also impart an internal circumferential velocity to the pulp particles. Pins 16 comb through the annulus of pulp which forms against the interior housing surface. The action of the pin rotor and pins 16 on the pulp fiber mat causes the mat to rotate and behave as a fluidized solid as it begins to fluff.

A series of guide foils 25 according to the present invention is used to control and direct the motion of the fluidized pulp fiber mat thus formed. Rows of guide foils also provide another surface for combing of the pulp mat, which increases fluff quality. Additionally, any bridging of pulp fibers between adjacent rotor pins 16 is cleared by the guide foils.

Each guide foil 25 consists of a flat "mat immersion" surface 33 and a lifting surface or tab 28. The guide foils may be disposed about the internal peripheral surface in an arrangement as shown in FIG. 5, wherein a number of the guide foils are mounted to a mounting plate 31, and aligned in an axially vertical arrangement to intercept the circumferentially induced flow of the fluffed pulp fiber mat.

The thus induced and controlled advance, turbulent, circumferential flow progresses under the force of gravity from the inlet 22 to an outlet 24. A reactant gas may be added at gas inlet 23, resulting in a turbulent mixture of gas and pulp for an extended circumferential path through the fluffer. The gas contact during fluffing results in extremely rapid and thorough gas contact with individual fibers, thereby allowing reaction to take place in a most efficient manner.

As shown in FIG. 7 and FIG. 8, a radial leading edge 30 is provided on each guide foil, which is set at a substantially right angle from a tangent of a surface of the cylindrical shell. The number of guide foils 25 placed around the circumference of the housing 12 is selected to provide sufficient surface interruption to assure the combing and shredding action effected by the rotating pins. Applicant has determined that a guide foil having leading edge substantially at right angle to a tangent of a surface of the shell provides unexpected results, as will be more fully described hereinbelow.

In addition, the guide foils 25 are used to control and direct the motion of the fluidized pulp mat in its circumferential path about the interior of the housing. This is accomplished by providing each guide foil with a flat mat immersion surface portion 33, followed by a lifting surface portion 28 which acts substantially in the nature of an aircraft wing elevator or aileron, by imparting a slight lift to the direction of the flowing mat between rows of guide foils. As the pulp mat slides pass the guide foils, an upward velocity is imparted. The mat continues to travel around the interior circumferential surface of fluffer housing 12 while the upward component of the velocity is dissipated by gravity, and the mat begins to drop. The mat accelerates downward, and reaches a vertical distance just below the point where it was lifted by the first foil.

At this point another guide foil will lift the mat repeating the process. This parabolic motion of the pulp fiber mat in the vertical orientation is repeated along the length of the machine. In U.S. Pat. No. 5,630,909, previously mentioned, a guide foil is described which has a leading edge set on an inwardly diverging angle from a surface of the foil attached to a cylindrical shell and a second foil surface being structured to impart a slight lifting as the pulp flows past the surface. It has been determined that the long leading edge with the diverging angle design limits the number of foils that can be spaced around the circumference of the cylindrical shell. The overall lifting effect of a mat of fiber in this design is limited by the number of foils that are placed around the circumference of the cylindrical shell. In certain sized fluffing contactors, in order to counteract the gravitational acceleration of the rotating, fluffed fiber mass, a greater lifting effect is needed than that provided by the design described in U.S. Pat. No. 5,630,909.

With the radial leading edge 30 of the present invention, the guide foil is designed to be half the length of the guide foils described in the Applicant's related Application U.S. Pat. No. 5,630,909 mentioned above in the circumferential direction, and adjacent guide foils are spaced closer together than the guide foils described in U.S. Pat. No. 5,630,909, which results in more total lifting effect to counteract the gravitational acceleration of the rotating fluffed fiber mass. Additionally, the radial leading edge will result in less axial dispersion of the pulp fibers than the diverging angle leading edge of U.S. Pat. No. 5,630,909, which is an advantage when using contactors according to the present invention. The diverging angle leading edge of U.S. Pat. No. 5,630,909 tends to move a portion of the rotating pulp fiber mat radially inward, which in turn results in some pulp being displaced downward and some upward as the pulp moves through the fluffing contactor with an overall result that the axial dispersion of the pulp is increased. In applications such as ozone bleaching, the pulp fibers should move through a contactor in such a way that all fibers are exposed to the bleaching agent for equal amounts of time, to be uniformly bleached. Less axial dispersion of the pulp fibers provides just such a result.

The guide foils allow the fluffer to be cylindrical rather than conical, which, apart from the advantage outlined above, results in a machine that has a lifting mechanism that does not change with the length of the machine. This results in a constant lifting force and thus a constant rate of through put and mat thickness.

A preferred circumferential spacing of between 12 and 20 inches between guide foils has been simulated; however, a wider range also is believed to be useful. Forming the lifting surface upward about a 30 inch radius for a length of 2 to 3 inches has proved effective in test apparatus. A four (4) inch mat thickness spacing between the drum 14 and the inner surface of the drum 12 has also proven effective. The above dimensions can be varied depending on equipment size, speed of rotation of the drum, degree of fluffing required and desired retention time.

It should also be appreciated by one skilled in the art that any desirable degree of lifting can be achieved in any section of the vessel. For example, greater lift may be effected at the top of the vessel during acceleration, and a reduction of lift accomplished in the lower portion of the vessel as the volume of fluff mat increases due to the fluffing action involved. During operation of the apparatus 10, the annulus of high consistency wood pulp mat moves axially through the housing. This may be accomplished by a variety of techniques; for example, in the vertical orientation, gravity accomplishes the movement. In orientations other than vertical, the guide vanes may be used to either assist or retard the flow in a particular direction, as may be required.

Additionally, axial movement of the pulp may be achieved by using the flow of a gaseous bleaching reagent introduced, for example, in inlet 23 to blow the fluff pulp through the housing. These actions, of course, will work in conjunction with the guide vanes to produce and control the flow through the housing, thereby producing a fluffed pulp having traversed an elongated, essentially parabolically varying spiral path through the fluffer from inlet to outlet. This action, in the presence of a reagent gas produces an intimate mix of the reagent gas, with the pulp being fluffed, for a time sufficiently long that substantial portions of the bleaching reaction occur, as, for example, the reaction that occurs when ozone gas, chlorine gas, or peroxide gas is utilized as a bleaching agent. The intimately mixed gas and fiber may thereafter be conveyed to a degasification vessel, wherein the gas reagent may be effectively separated.

In the prior art, one method for accomplishing separation is a fixed bed device wherein the pulp bed is allowed to compact and thereby assist in the pressing out of the residual reacting gas. This type of vessel has also proved to be an effective and efficient device for allowing the intimately contacted reactant gas to complete its reaction without mechanical induced fiber degradation.

Figure 4:
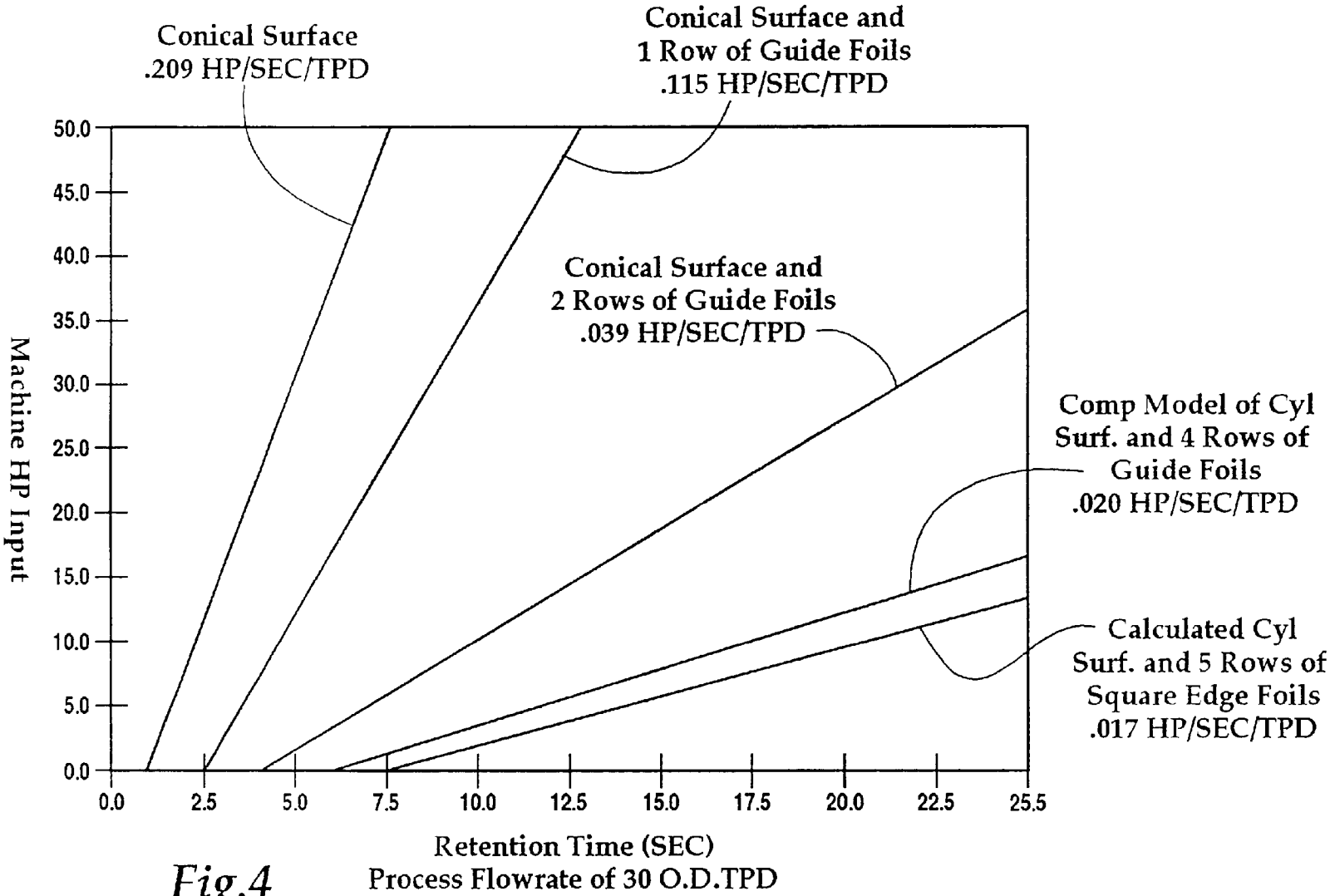
FIG. 4 is a graph showing the calculated increase in retention time for a given power input for the present invention vs. pilot plant results for a conical surface of the prior art and calculated values for the diverging angle foil described in Ser. No. 08/335,282.

FIG. 4 shows the substantial increase in retention time effected by a device according to the present invention as compared to a device having a conical surface only and a device having the diverging angle foil described in U.S. Pat. No. 5,630,909, for example, for a given horsepower.

High retention time for a given energy input is important for several reasons. It has been found in the laboratory that a total energy input into the pulp of 0.4 Hp/O.D.TPD is sufficient to create good quality fluff, as measured by image analysis. Increasing the total input energy results in little additional fluff quality, and can cause fiber damage and high machine wear rates. Low energy transfer rates result in a preferred, gentle combing action. High total energy input also increases the pulp stream discharge temperature, which is detrimental to the bleaching process.

In the pilot plant using a two degree cyclone, the effectiveness of the guide foils was readily apparent, showing increases in retention time of, for example, 4 to 7 seconds and a decrease in energy transfer rate of 0.209 to 0.115 Hp/sec/O.D.TPD for a single row of guide foils. Two rows of guide foils cause a still larger increase in retention time and a corresponding decrease in energy transfer rate. Analytical models based on pilot plant results predict that a cylindrically shaped machine with 4 rows of diverging angle guide foils will result in energy transfer rates of 0.02 Hp/sec/O.D.TPD, which gives a total energy input of 0.4 Hp/O.D.TPD at 20 seconds retention time. As previously mentioned, more foils produce more lift. However, the number of diverging angle foils like those described in U.S. Pat. No. 5,630,909 placed around the circumference of a cylindrically shaped machine is limited because of the length of foil needed to create the diverging angle. Not only do more foils produce more lift, i.e., the square leading edge of the present invention, more foils produce a given retention time at a lower horsepower.

For the two degree prior art cyclone contactor used to generate the graphs of FIG. 4, the flat section of the foil is 18 degrees long and the curved or lifting section is 12 degrees. Computational results show that using a maximum of 4 rows of these foils produces a space of 54 degrees between the foils. According to the present invention, shortening the flat section 33 to 6 degrees, five rows of foils are installed with the same amount of space between the foils. Based on these calculations, the retention time will increase by 17%.

Thus, calculations show that a cylindrically shaped machine with 5 rows of square leading edge foils will result in energy transfer rates of 0.017 Hp/sec/O.D.TPD. In other words, more foils cause an increase in retention time and a corresponding decrease in energy transfer rate.

While this invention has been illustrated and described in accordance with a preferred embodiment, it is recognized that variations and changes may be made therein without departing from the invention as set forth in the following claims:

What is claimed is:

1. A pulp fluffing contactor comprising:

a cylindrical shell having a solids inlet adjacent one end and a solids outlet adjacent an opposite end and a gas inlet for introducing a gas into said shell;

a cylindrical rotor mounted for rotation within said shell of sufficient diameter to form a restricted annular space of convenient axial length;

said rotor being further provided with a plurality of radially outward extending projections subscribing a rotary path for imparting a circumferential swirl to sold fibrous material introduced within the shell;

said shell being further provided with a plurality of guide foils projecting into said annular space intermediate the rotary paths subscribed by said projections and oriented generally parallel to said rotary paths;

said guide foils further comprise a first combing portion and a second axially directing portion set at an arcuate angle to said rotary paths for axially directing said circumferential swirl; and each guide foil combing portion having a leading edge being set at a substantially right angle from a tangent of a surface of the cylindrical shell and the second foil portion being structured to impart a slight lifting as the pulp flows past the surface.

2. A fluffing contactor according to claim 1, wherein: said guide vanes are set apart circumferentially between 12 and 20 inches on said shell.

3. A fluffing contactor according to claim 1, wherein: said arcuate angle to said rotary path for a second axially directing portion of said guide foils is set at an angle to control axial advancement of said circumferential swirl of solid fibrous material introduced within said shell.

4. A fluffing contactor according to claim 1, wherein: said projections are pins.

5. A fluffing contactor according to claim 1, wherein: said gas is a reagent gas.

6. A fluffing contactor according to claim 1, wherein: said restricted annular space is between from about 2 inches and 10 inches in depth.

7. A fluffing contactor according to claim 1, wherein: said restricted annular space is approximately 6 inches in depth.

8. A fluffing contactor according to claim 1; wherein: said projections extend substantially through said restricted annular space.

9. A fluffing contactor according to claim 1, wherein: said guide foils extend substantially through said restricted annular space.

10. A fluffing contactor according to claim 5, wherein: said reagent gas is a bleaching gas.

11. A fluffing contactor according to claim 10 wherein: said bleaching gas is a mixture of ozone and oxygen.

12. A fluffing contactor according to claim 1 wherein: said second foil portion is formed upward at a determined angle to provide a compensating lift from inlet to outlet, to increase residence time in said contactor.

13. A fluffing contactor according to claim 1, wherein: said second foil portion is formed upward at an angle to promote flow.

14. A pulp fluffing contactor comprising:

a vertically orientated cylindrical shell having a solids inlet adjacent a top end and a solids outlet adjacent a bottom end and a gas inlet for introducing a gas into said shell;

a cylindrical rotor mounted for rotation within said shell of sufficient diameter to form a restricted annular space of convenient axial length;

said rotor being further provided with a plurality of radially outward extending projections subscribing a rotary path for imparting a circumferential swirl to solid fibrous material introduced within the shell;

said shell being further provided with a plurality of guide foils projecting into said annular space intermediate the rotary paths subscribed by said projections and oriented generally parallel to said rotary paths;

said guide foils being further provided with a leading first combing portion oriented substantially parallel to said rotary paths and a second portion set at an arcuate angle to said rotary paths providing an axially directing portion; and each guide foil combing portion having a leading edge being set at a substantially right angle from a tangent of a surface of the cylindrical shell and the second foil portion being structured to impart a slight lifting as the pulp flows past the surface.

* * * * *